US011135621B2

(12) United States Patent
Liu et al.

(10) Patent No.: US 11,135,621 B2
(45) Date of Patent: Oct. 5, 2021

(54) REMOTE-CONTROLLED GASOLINE CLEANER

(71) Applicant: SUMEC HARDWARE & TOOLS CO., LTD., Nanjing (CN)

(72) Inventors: Kai Liu, Nanjing (CN); Ying-Dian Xiang, Nanjing (CN); Feng Zhou, Nanjing (CN); Xue-Song Gao, Nanjing (CN); Yong Pei, Nanjing (CN); Xu Zhang, Nanjing (CN)

(73) Assignee: SUMEC HARDWARE & TOOLS CO., LTD., Nanjing (CN)

( * ) Notice: Subject to any disclaimer, the term of this patent is extended or adjusted under 35 U.S.C. 154(b) by 280 days.

(21) Appl. No.: 16/434,606

(22) Filed: Jun. 7, 2019

(65) Prior Publication Data

US 2020/0086357 A1 Mar. 19, 2020

(30) Foreign Application Priority Data

Sep. 18, 2018 (CN) ..... 201811085581.8

(51) Int. Cl.
*B08B 3/02* (2006.01)
*F02N 11/08* (2006.01)
(Continued)

(52) U.S. Cl.
CPC ..... *B08B 3/028* (2013.01); *B05B 12/002* (2013.01); *B08B 3/02* (2013.01); *B08B 13/00* (2013.01);
(Continued)

(58) Field of Classification Search
CPC ..... B08B 3/028; B08B 3/02; B08B 13/00; B08B 2203/0241; B05B 12/002; F02N 11/0807; F02N 11/0814; F02N 11/087
(Continued)

(56) References Cited

U.S. PATENT DOCUMENTS 7,474,943 B2 * 1/2009 Matsubara ..... F02D 41/064 123/179.2
9,051,927 B2 6/2015 Gilpatrick et al.
(Continued)

FOREIGN PATENT DOCUMENTS

EP 2985083 A1 2/2016
FR 2929651 B1 11/2011
WO WO 2013059028 A1 4/2013

*Primary Examiner* — Mahmoud Gimie
(74) *Attorney, Agent, or Firm* — Muncy, Geissler, Olds & Lowe, P.C.

(57) ABSTRACT

A remote-controlled gasoline cleaner including a main unit, sprayer, and remote control. The main unit includes a controller, start switch device, stop switch device, and gasoline engine start/stop apparatus. The remote control sends a start remote control signal or stop remote control signal to the main unit. The controller controls the start switch device in response to the start remote control signal received, and controls the stop switch device in response to the stop remote control signal received. The start switch device receives a start command of the controller to connect to a power supply circuit of a starter motor in the gasoline engine start/stop apparatus. The starter motor starts a gasoline engine. The stop switch device receives a stop command of the controller to connect to a short circuit of an ignition coil in the gasoline engine start/stop apparatus, thereby blowing out the gasoline engine.

9 Claims, 1 Drawing Sheet

(51) Int. Cl.
*B05B 12/00* (2018.01)
*B08B 13/00* (2006.01)

(52) U.S. Cl.
CPC ..... *F02N 11/087* (2013.01); *F02N 11/0807* (2013.01); *F02N 11/0814* (2013.01); *B08B 2203/0241* (2013.01)

(58) Field of Classification Search
USPC ..... 123/179.2
See application file for complete search history.

(56) References Cited

U.S. PATENT DOCUMENTS

| | | | | |
|---|---|---|---|---|
| 2002/0088419 | A1* | 7/2002 | Wisnia | F02N 11/0807 123/179.2 |
| 2004/0050355 | A1 | 3/2004 | Harris et al. | |
| 2007/0257769 | A1* | 11/2007 | Matsubara | B60R 25/209 340/5.61 |
| 2013/0092745 | A1 | 4/2013 | Karp | |
| 2013/0214059 | A1 | 8/2013 | Gilpatrick et al. | |
| 2017/0239676 | A1* | 8/2017 | Kristensen | B05B 9/0403 |

* cited by examiner

REMOTE-CONTROLLED GASOLINE CLEANER

BACKGROUND OF THE INVENTION

1. Technical Field

Cleaners are cleaning equipment for turning tap water or the like into pressurized water by an electrically-driven high-pressure plunger. The cleaners each have a sprayer for spraying pressurized water on an object to be cleaned, for example, a vehicle, ship, ground, and wall, so as to remove therefrom dust, sludges, oil stains, and dirt, respectively. The cleaners embody a means of cleaning with globally recognized advantages, namely economical and environment-friendly. Therefore, the cleaners are cleaning equipment indispensable to daily life and increasingly popular.

Depending on how they are powered, existing cleaners can be divided into two categories: electrical cleaners and gasoline cleaners. According to the prior art, some existing electrical cleaners operate through long-distance remote control, usually by controlling the start and shutdown of engines in the electrical cleaners through long-distance remote control to thereby effect the start and shutdown of the electrical cleaners through long-distance remote control. However, with a gasoline engine being completely different from the engine in terms of structural features, remote-controlled gasoline cleaners are currently unavailable. Existing gasoline cleaners still start by hand. Upon completion of a cleaning process, existing gasoline cleaners cannot shut down at any time but have to stand by for a while. To shut down the existing gasoline cleaners, users have to reach main units of the existing gasoline cleaners from a distance. When operating in the standby mode, the existing gasoline cleaners not only perform useless work but also generate noise pollution, because the existing gasoline cleaners use heat generated and circulated within a pump to trigger thermovalves to drain water and let in cool water to keep the engines operating.

In conclusion, existing gasoline cleaners cannot be remotely controlled from a distance and are inconvenient to start and shut down, whereas their standby mode causes a waste of energy, generates noise and produces exhaust pollution.

BRIEF SUMMARY OF THE INVENTION

The present disclosure provides a remote-controlled gasoline cleaner which overcomes its conventional counterparts' drawbacks: cannot be remotely controlled from a distance and are inconvenient to start and shut down, whereas their standby mode causes a waste of energy and produces pollution.

To overcome the aforesaid drawbacks of the prior art, the present disclosure provides a remote-controlled gasoline cleaner including a main unit and a sprayer, further comprising a remote control. The main unit comprises a controller, start switch device, stop switch device and gasoline engine start/stop apparatus.

The remote control sends a start remote control signal or a stop remote control signal to the main unit.

The controller controls the start switch device in response to the start remote control signal received and controls the stop switch device in response to the stop remote control signal received.

The start switch device receives a start command of the controller to connect to a power supply circuit of a starter motor in the gasoline engine start/stop apparatus. The starter motor starts a gasoline engine. The power supply circuit of the starter motor opens after the gasoline engine has operated normally.

The stop switch device receives a stop command of the controller to connect to a short circuit of an ignition coil in the gasoline engine start/stop apparatus, thereby blowing out the gasoline engine.

The main unit further comprises an automatic reset blow-out switch parallel-connected to two ends of the ignition coil, and the automatic reset blow-out switch turns off, thereby shorting the ignition coil.

The main unit further comprises a start button for sending a button signal to the controller when pressed, and the controller sends a start command to the start switch device to start the gasoline engine.

The main unit further comprises a start button and a power supply switch device. The start button sends a button signal to the controller and the power supply switch device when pressed, and the power supply switch device creates a circuit between a power and the controller, wherein the controller controls the remote-controlled gasoline cleaner in converting from a standby state to an operating state and sends a start command to the start switch device so as to start the gasoline engine.

The main unit further comprises a gasoline engine testing module for testing a current operation state of the gasoline engine, and the controller does not send a start command after receiving the start remote control signal, if a test result shows that the gasoline engine has started.

The starter motor and the controller share a power supplied to the starter motor and the controller through a master control switch.

The remote control comprises a first wireless communication module. The main unit further comprises a second wireless communication module. The second wireless communication module is connected to the controller. The second wireless communication module and the first wireless communication module are in wireless communication with each other.

The remote control further comprises a start trigger switch and a stop trigger switch. Both the start trigger switch and the stop trigger switch are connected to the first wireless communication module and send the start remote control signal and the stop remote control signal to the second wireless communication module, respectively.

The remote control is mounted on the sprayer.

The sprayer has a receiving portion thereon such that the remote control is engaged with the receiving portion.

The present disclosure achieves advantages as follows: 1. the present disclosure makes great start/stop-related improvements and thus controls the start/stop of the gasoline engine by long-distance remote control to thereby allow users far away from the main unit to effectuate start/stop in the course of a cleaning process, stop the gasoline engine by remote control in a standby mode, and overcome drawbacks of conventional gasoline cleaners in a standby mode: their engines keep operating and thus cause a waste of energy, generate noise, and produce exhaust pollution; 2. the present disclosure has various start modes and stop modes for starting/stopping in respective scenarios, thereby enhancing the ease of operation.

DETAILED DESCRIPTION OF THE INVENTION

The present disclosure is described below and depicted by accompanying drawings. The embodiments presented below are only intended to illustrate the present disclosure but are not restrictive of the claimed scope of the present disclosure.

Figure 1:
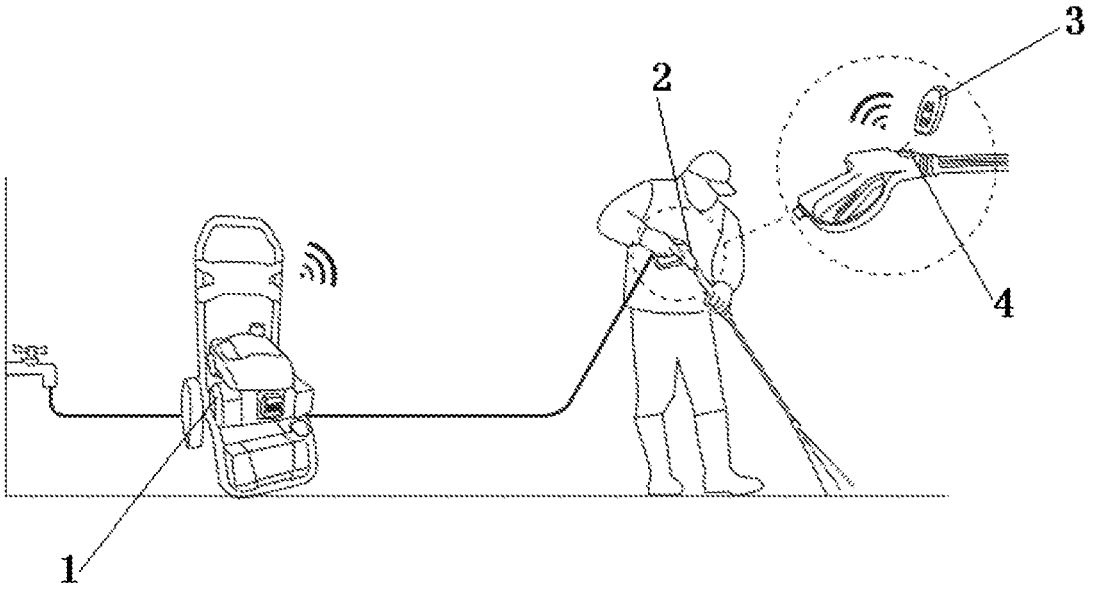
FIG. 1 is a schematic view of a remote-controlled gasoline cleaner of the present disclosure.

As shown in FIG. 1, a remote-controlled gasoline cleaner of the present disclosure comprises a main unit 1 and a sprayer 2. The main unit 1 comprises a gasoline engine and a booster pump driven by the gasoline engine. The input end of the booster pump is connected to a water source by a pipe. The output end of the booster pump is connected to the sprayer 2 by a pipe. The aforesaid structural features of the remote-controlled gasoline cleaner of the present disclosure are similar to the structural features of conventional gasoline cleaners and thus, for the sake of brevity, are not further described hereunder.

The remote-controlled gasoline cleaner further comprises a remote control 3. The remote control 3 sends a start remote control signal or a stop remote control signal to the main unit 1. The remote control 3 comprises a first wireless communication module 7, a start trigger switch 11 and a stop trigger switch 12. The first wireless communication module 7 and the main unit 1 are in wireless communication with each other. Both the start trigger switch 11 and the stop trigger switch 12 are connected to the first wireless communication module 7 and send the start remote control signal and the stop remote control signal to the main unit 1, respectively. The remote control 3 further comprises a power supply component, such as button battery or dry battery, adapted to supply power to components of the remote control 3.

To facilitate operation, the remote control 3 is directly mounted on the sprayer 2. The remote control 3 and the handle of the sprayer 2 are integrally formed. Alternatively, the remote control 3 and the handle of the sprayer 2 are separately formed. As shown in FIG. 1, the remote control 3 is self-contained, whereas the sprayer 2 has a receiving portion 4 thereon such that the remote control 3 can be engaged with the receiving portion 4. The remote control 3 can be removed from the receiving portion 4 without using any tool.

Figure 2:
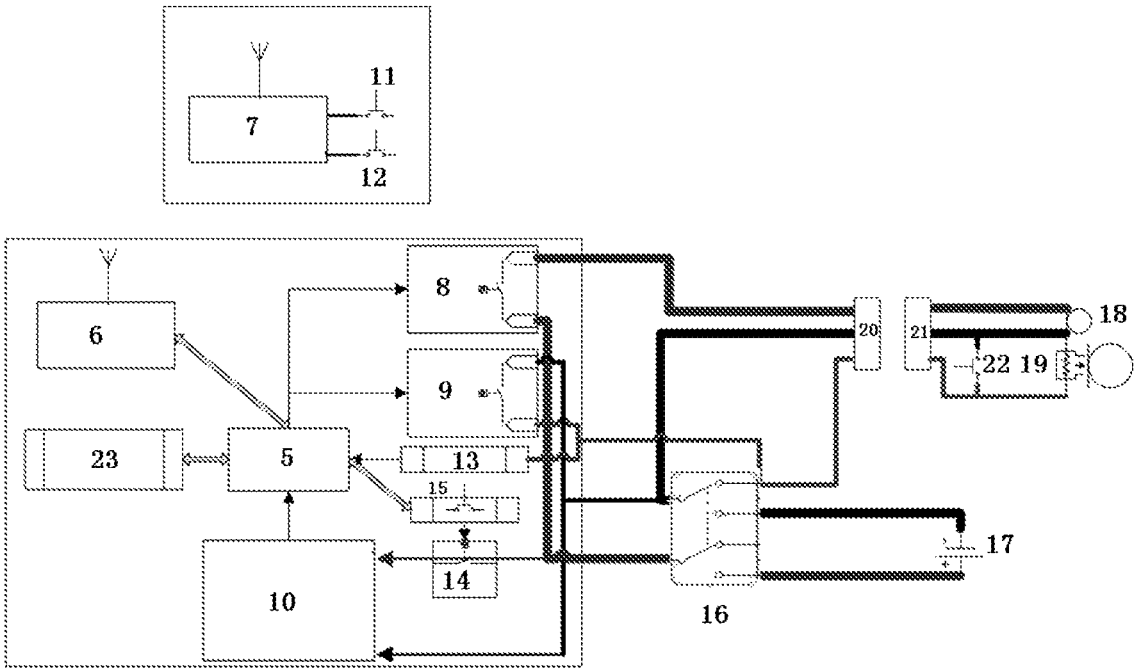
FIG. 2 is a block diagram of circuitry of the remote-controlled gasoline cleaner of the present disclosure.

Referring to FIG. 2, the main unit 1 further comprises the control circuit of the gasoline engine. The control circuit of the gasoline engine comprises a controller 5, a start switch device 8, a stop switch device 9, an automatic reset blow-out switch 22, a start button. 15, a power supply switch device 14, a power conversion module 10, a gasoline engine testing module 13, a second wireless communication module 6, an LED23, a master control switch 16, a gasoline engine start/stop apparatus and a power 17.

The gasoline engine testing module 13 tests the current operation state of the gasoline engine and sends a test result to the controller 5.

The gasoline engine testing module 13 is a conventional module and thus is not described in detail herein. The gasoline engine testing module 13 determines the current state of the gasoline engine by testing ignition coil pulses or testing a signal parameter, such as engine rotation speed.

The controller 5 controls the start switch device 8 in response to the start remote control signal or button signal received, controls the stop switch device 9 in response to the stop remote control signal received, and receives the test result sent from the gasoline engine testing module 13. If the test result shows that the gasoline engine has started, the controller 5 will not send the start command after receiving the start remote control signal, and thus will prevent the started gasoline engine from starting again, so as to prevent mechanical damage from happening to the mechanical connection of a starter motor and the gasoline engine.

The controller 5 is provided in the form of an MCU, for example, Fujitsu's MB95F012, MB95013, MB95F264, Fortior's FU6818, Nuvoton's N76E003, and Holtek's HT66F.

The gasoline engine start/stop apparatus comprises a starter motor 18, an ignition coil 19 and the gasoline engine. When the gasoline engine start/stop apparatus starts, the starter motor 18 rotates and drives (through a deceleration mechanism) a flywheel and a crankshaft connecting rod of the gasoline engine to rotate. As soon as the rotation speed of the crankshaft reaches the ignition rotation speed, an electrical current is passed through the primary coil of the ignition coil 19, and thus the secondary coil of the ignition coil 19 generates high-voltage electric power. The high-voltage electric power causes a spark plug to achieve ignition, thereby starting the gasoline engine. After the gasoline engine has started or disabled the start command, the starter motor 18 stops. Stopping the gasoline engine entails shorting the ignition coil 19. To facilitate its connection, the gasoline engine start/stop apparatus is connected to a control circuit through a socket 20 and a plug 21.

The start switch device 8 receives the start command of the controller 5 and connects to a power supply circuit of the starter motor 18. At this point in time, the starter motor 18 operates and thereby starts the gasoline engine. As soon as the gasoline engine starts, the power supply circuit of the starter motor 18 opens, and the power supply circuit of the starter motor 18 stays open while the gasoline engine is operating.

The stop switch device 9 receives a stop command of the controller 5 to connect to a short circuit of the ignition coil 19. When a specific time period has lapsed, the load in the ignition coil 19 has been completely released, the short circuit of the ignition coil 19 opens immediately, thereby blowing out the gasoline engine.

The start switch device 8 and the stop switch device 9 are provided in the form of MOS pipes or relays, for example, Hongfa's HF3FF, and NCE30H10 produced by WUXI NCE POWER.

The automatic reset blow-out switch 22 is parallel-connected to two ends of the ignition coil 19, and the automatic reset blow-out switch 22 turns off, thereby shorting the ignition coil 19.

The automatic reset blow-out switch 22 is provided in the form of an automatic reset button. If the remote control 3 runs out of power or gets damaged, the user presses the automatic reset button for several seconds (usually 3 seconds) such that the gasoline engine stops. Afterward, the user releases the automatic reset button to effect automatic reset.

The power conversion module 10 is also a conventional component and is connected to the controller 5, so as to supply power to the gasoline cleaner. The purpose of the power conversion module 10 is to transform the voltage of the power 17 to be input such that the voltage of the power 17 satisfies the gasoline cleaner.

The power supply switch device 14 is series-connected to a circuit between the power 17 and the controller 5, preferably a circuit between the power 17 and the power conversion module 10.

The power supply switch device 14 is provided in the form of an MOS pipe, for example, AOS's AO3401A.

The start button 15 is also provided in the form of an automatic reset button. When pressed, the start button 15 sends a button signal to the controller 5 and the power supply switch device 14. The power supply switch device 14 is connected to the circuit between the power 17 and the controller 5; hence, an electrical current is passed through the gasoline cleaner (if the power supply switch device 14 is not connected to the circuit between the power 17 and the controller 5 initially, the user will need to press the start button 15 so as for the power supply switch device 14 to be connected to the circuit between the power 17 and the controller 5; if the power supply switch device 14 has already been connected to the circuit between the power 17 and the controller 5 initially, the power supply switch device 14 will not take any action) such that the controller 5 controls the gasoline cleaner in converting from a standby state to an operating state and sends the start command to the start switch device 8 to thereby start the gasoline engine. Furthermore, the user may press and hold the start button 15 in order to effect the code matching of the remote control 3 and the main unit 1.

When the gasoline cleaner is not in use, the main unit 1 and the sprayer 2 are placed side by side. To begin using the gasoline cleaner, the user grabs the sprayer 2 and presses the start button 15 to start the gasoline cleaner, thereby enhancing the ease of use of the gasoline cleaner.

The power 17 is provided in the form of a rechargeable battery pack and adapted to supply power to the starter motor 18 and the controller 5. The starter motor 18 and the controller 5 share the power 17, and the power 17 is supplied to the starter motor 18 and the controller 5 through the master control switch 16.

The master control switch 16 is a main switch provided in the form of a double pole double throw (DPDT) switch. The user turns on the master control switch 16 to interrupt the power supply to the starter motor 18 and the controller 5.

The LED 23 is connected to the controller 5 and adapted to indicate the status of the gasoline cleaner and the status of the gasoline engine.

The second wireless communication module 6 and the first wireless communication module 7 are in wireless communication with each other. The second wireless communication module 6 is connected to the controller 5 and receives the start remote control signal and the stop remote control signal sent from the first wireless communication module 7.

The gasoline cleaner has various start/stop modes for starting/stopping in respective scenarios, thereby enhancing the ease of operation. The start/stop modes are as follows:

Start Modes:

A1: start by a conventional pulling cord, i.e., the user pulls the pulling cord by hand to start the gasoline engine; A1 works only as a last resort, when neither the start button 15 nor the remote control 3 can start the gasoline cleaner;

B1: the master control switch 16 is turned on such that the start button 15 starts; B1 is applicable to a first-instance start or the situation where the remote control 3 runs out of power or gets damaged;

C1: the master control switch 16 is turned on such that the remote control 3 starts; C1 is applicable to the situation where users are far away from the main unit 1.

Stop Modes:

A2: the automatic reset blow-out switch 22 stops; A2 is applicable whenever the remote control 3 runs out of power or gets damaged;

B2: the master control switch 16 is turned on such that the remote control 3 stops; B2 is applicable to the situation where users are far away from the main unit 1;

C2: the master control switch 16 is turned off directly; C2 works only as a last resort, when neither the automatic reset blow-out switch 22 nor the remote control 3 can start the gasoline cleaner.

The gasoline cleaner of the present disclosure controls the gasoline engine start/stop apparatus by long-distance remote control and thereby controls the start/stop of the gasoline engine, thereby sparing users the hassles of approaching the main unit 1 with a view to starting/stopping the gasoline cleaner. The gasoline cleaner of the present disclosure is easier to start/stop than conventional gasoline cleaners. When operating in a standby mode, the gasoline cleaner of the present disclosure is further advantageous in that the gasoline engine can be stopped by remote control to thereby overcome drawbacks of conventional gasoline cleaners: during a standby mode, the engine keeps operating and thus causes a waste of energy, generates noise and produces exhaust pollution.

The present disclosure is disclosed above by preferred embodiments. Persons skilled in the art can make improvements and variations to the preferred embodiments without departing from the technical principles of the present disclosure. The improvements and variations shall be deemed falling within the claimed scope of the present disclosure.

What is claimed is:

1. A remote-controlled gasoline cleaner including a main unit and a sprayer, comprising a remote control, the main unit comprising a controller, a start switch device, a stop switch device and a gasoline engine start/stop apparatus;

wherein the remote control sends a start remote control signal or a stop remote control signal to the main unit;

wherein the controller controls the start switch device in response to the start remote control signal received and controls the stop switch device in response to the stop remote control signal received;

wherein the start switch device receives a start command of the controller to connect to a power supply circuit of a starter motor in the gasoline engine start/stop apparatus, the starter motor starting a gasoline engine, wherein the power supply circuit of the starter motor opens after the gasoline engine has operated normally;

wherein the stop switch device receives a stop command of the controller to connect to a short circuit of an ignition coil in the gasoline engine start/stop apparatus, thereby blowing out the gasoline engine;

wherein the main unit further comprises an automatic reset blow-out switch parallel-connected to two ends of the ignition coil, and the automatic reset blow-out switch turns off, thereby shorting the ignition coil.

2. The remote-controlled gasoline cleaner of claim 1, wherein the main unit further comprises a start button for sending a button signal to the controller when pressed, and the controller sends a start command to the start switch device to start the gasoline engine.

3. The remote-controlled gasoline cleaner of claim 1, wherein the main unit further comprises a start button and a power supply switch device, the start button sends a button signal to the controller and the power supply switch device when pressed, and the power supply switch device creates a circuit between a power and the controller, wherein the controller controls the remote-controlled gasoline cleaner in converting from a standby state to an operating state and sends a start command to the start switch device so as to start the gasoline engine.

4. The remote-controlled gasoline cleaner of claim 1, wherein the main unit further comprises a gasoline engine testing module for testing a current operation state of the gasoline engine, and the controller does not send a start command after receiving the start remote control signal, if a test result shows that the gasoline engine has started.

5. The remote-controlled gasoline cleaner of claim 1, wherein the starter motor and the controller share a power supplied to the starter motor and the controller through a master control switch.

6. The remote-controlled gasoline cleaner of claim 1, wherein the remote control comprises a first wireless communication module, and the main unit further comprises a second wireless communication module, with the second wireless communication module connected to the controller, wherein the second wireless communication module and the first wireless communication module are in wireless communication with each other.

7. The remote-controlled gasoline cleaner of claim 6, wherein the remote control further comprises a start trigger switch and a stop trigger switch, both the start trigger switch and the stop trigger switch are connected to the first wireless communication module and send the start remote control signal and the stop remote control signal to the second wireless communication module, respectively.

8. The remote-controlled gasoline cleaner of claim 6, wherein the remote control is mounted on the sprayer.

9. The remote-controlled gasoline cleaner of claim 8, wherein the sprayer has a receiving portion thereon such that the remote control is engaged with the receiving portion.

* * * * *